United States Patent [19]

De Soto

[11] 4,060,876

[45] Dec. 6, 1977

[54] WALLET SUPPORTING CLIP

[76] Inventor: Diogenes De Soto, 2831 Florida Ave., Miami, Fla. 33133

[21] Appl. No.: 704,995

[22] Filed: July 14, 1976

[51] Int. Cl.[2] ..... A44B 21/00

[52] U.S. Cl. ..... 24/3 J; 224/26 D

[58] Field of Search ..... 24/3 J, 3 L, 3 R, 73 R, 24/3 K; 224/26 D, 26 R, 26 H, 26 J, 26 K, 27; 223/95, 85, 88

[56] References Cited

U.S. PATENT DOCUMENTS

| | | | |
|---|---|---|---|
| 1,341,811 | 6/1920 | Lutz | 24/3 K |
| 1,588,630 | 6/1926 | Smith | 24/3 L |
| 1,679,606 | 8/1928 | Graves | 224/26 D |
| 1,816,284 | 7/1931 | Hughes | 224/26 D |
| 2,264,957 | 12/1941 | Shafarman | 223/DIG. 1 |
| 3,361,312 | 1/1968 | Hutchinson | 224/26 D |

*Primary Examiner*—George H. Krizmanich

[57] ABSTRACT

A wallet supporting clip which includes a clip portion to attach to the belt of a wearer between the inside surface of trousers and the body of a wearer and which has attached to it a link with an opening through which a wallet may be passed.

2 Claims, 3 Drawing Figures

WALLET SUPPORTING CLIP

FIELD OF THE INVENTION

This invention relates to clips for carrying wallets in a suspended condition from the belt of a wearer.

BACKGROUND OF THE INVENTION

As is perhaps well known people often lose billfolds or they are stolen. This invention is of a device for carrying a billfold in a manner so that the wallet is not likely to be stolen or lost.

It is, accordingly, an object of this invention to provide an improved wallet carrying device and which, as shown in the enclosed drawings and described more fully hereinafter includes a clip for attachment to a belt and a loop or link suspended from the clip and through which a foldable wallet may be passed to be inserted and draped from the loop or link so that the device may be suspended from the inside belt of a wearer.

In accordance with these and other objects, which will become apparent hereinafter, the instant invention will now be described with reference to the accompanying drawings, in which:

DETAILED DESCRIPTION OF THE DRAWINGS

Figure 1:
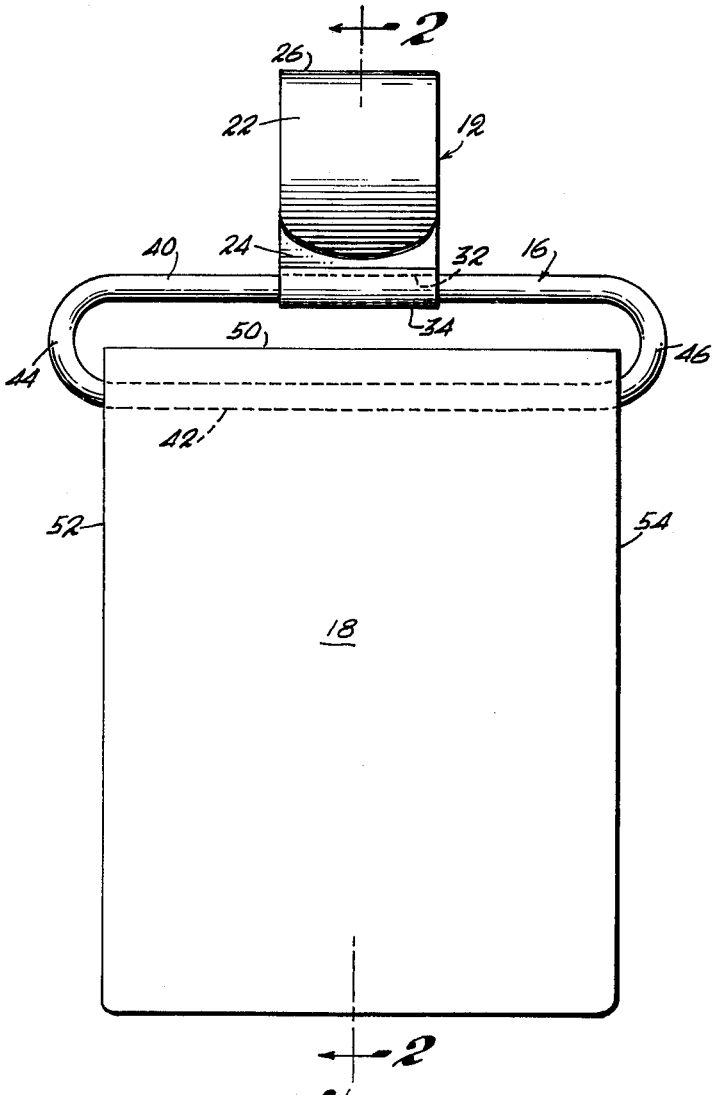
FIG. 1 is a front elevation view of the instant invention.
Figure 2:
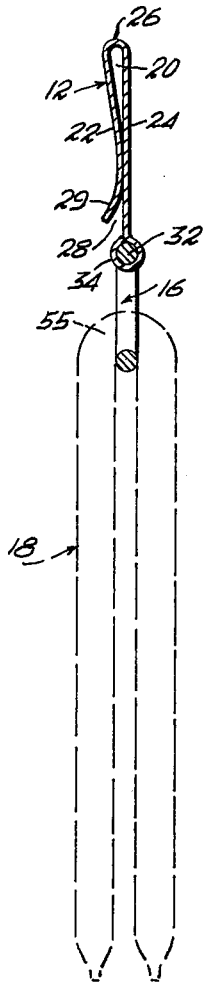
FIG. 2 is a view in cross section taken on the plane indicated by line 2—2 of FIG. 1 and looking in the direction of the arrows.
Figure 3:
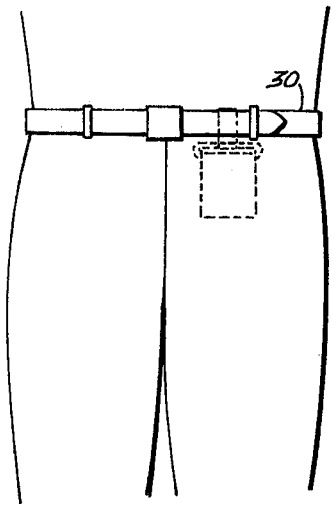
FIG. 3 is a view illustrating the use of the instant invention.

Referring to the drawings wherein like reference characters designate like or corresponding parts throughout the several views, there is shown in FIG. 2 a clip 12 for supporting a link 16 from which a wallet 18 is suspended in a manner to be described. The clip has a bight 20 between a pair of resilient legs 22 and 24 on opposite sides of a hairpin turn 26 which is open as at 28 with the end 29 being flared somewhat outwardly. The belt 30 of a wearer, see FIG. 3 is utilized to suspend the clip, after a wallet has been positioned over it, as indicated in FIG. 2. The belt is inserted into the bight of the clip, with the link being captivated as at 32 by a lower end zone 34 of the clip being secured about it. The link 32 includes opposite sides 40 and 42 which, as shown, are of equal length and joined at their respective ends by end zones 44 and 46 which close the links. A wallet 18 which is of the foldable conventional type is draped, as shown in FIG. 2, over the lower side 42 of the link, the length of the link being sufficient to span the shorter distance represented by the side 50 in FIG. 1 between the longitudinally extending edges 52 and 54 of the billfold. In use, the wearer merely drapes the billfold over the link by passing it through it to the foldable zone 55, see FIG. 2, and, thereafter, clips it inside his pants to his belt, where it is invisible and cannot be readily stolen.

What is claimed is:

1. A foldable wallet suspending device for supporting a wallet between a pair of trousers and a wearer comprising a clip having an inner leg and an outer leg on opposite sides of a hairpin turn, the inner opposed surfaces of said inner and outer legs defining belt-engaging means with the outer or opposite side of said inner leg defining a body-engaging surface, each of said legs having a terminal end zone, and an elongated link fixed on the upper portion thereof to the terminal zone of said inner leg with the lower portion thereof defining a foldable wallet-receiving support bar.

2. The device as set forth in claim 1 wherein the terminal end zone of said inner leg is outwardly flared.

* * * * *